US008176850B2

(12) United States Patent
Thompson et al.

(10) Patent No.: US 8,176,850 B2
(45) Date of Patent: May 15, 2012

(54) SPECIAL PURPOSE SMALL ARMS AMMUNITION

(75) Inventors: David Thompson, Elizabeth (AU); Alexander Krstic, Elizabeth (AU)

(73) Assignee: XTEK Limited, Elizabeth (AU)

( * ) Notice: Subject to any disclaimer, the term of this patent is extended or adjusted under 35 U.S.C. 154(b) by 6 days.

(21) Appl. No.: 12/837,704

(22) Filed: Jul. 16, 2010
(Under 37 CFR 1.47)

(65) Prior Publication Data

US 2011/0107937 A1 May 12, 2011

Related U.S. Application Data

(63) Continuation-in-part of application No. 12/246,010, filed on Oct. 6, 2008, now abandoned, which is a continuation of application No. 11/584,736, filed on Oct. 19, 2006, now Pat. No. 7,455,015.

(51) Int. Cl.
*F42B 14/06* (2006.01)

(52) U.S. Cl. ..... 102/520; 102/518; 102/501

(58) Field of Classification Search ..... 102/439, 102/501, 517, 520, 521, 522, 518
See application file for complete search history.

(56) References Cited

U.S. PATENT DOCUMENTS

| | | | | | |
|---|---|---|---|---|---|
| 37,260 | A | | 12/1862 | Smith | 102/522 |
| 2,983,224 | A | | 5/1961 | Prosen | 102/522 |
| 3,005,408 | A | | 10/1961 | Prosen at al. | 102/522 |
| 3,111,902 | A | | 11/1963 | Taylor | 102/521 |
| 3,747,533 | A | * | 7/1973 | Rossmann | 102/529 |
| 3,762,332 | A | | 10/1973 | Witherspoon et al. | 102/523 |
| 3,795,196 | A | * | 3/1974 | Hillenbrand | 102/518 |
| 3,948,184 | A | * | 4/1976 | Pierre et al. | 102/522 |
| 4,444,112 | A | | 4/1984 | Strandli et al. | 102/364 |
| 4,574,703 | A | | 3/1986 | Halverson | 102/520 |
| 4,644,865 | A | | 2/1987 | Lawrence | 102/430 |
| 4,676,169 | A | | 6/1987 | Maki | 102/439 |
| 4,800,816 | A | | 1/1989 | Meyer | 102/523 |
| 5,182,419 | A | * | 1/1993 | Burnette | 102/523 |
| 5,339,743 | A | | 8/1994 | Scarlata | 102/439 |
| 6,814,006 | B2 | | 11/2004 | Johansson | 102/522 |
| 6,997,110 | B2 | | 2/2006 | Rastegar | 102/502 |
| 7,455,015 | B2 | | 11/2008 | Krstic | 102/522 |
| 2005/0016414 | A1 | | 1/2005 | Leitner-Wise | 102/522 |
| 2007/0234925 | A1 | | 10/2007 | Dunn et al. | 102/522 |

* cited by examiner

*Primary Examiner* — James Bergin
(74) *Attorney, Agent, or Firm* — Dergosits & Noah LLP; Todd A. Noah

(57) ABSTRACT

A multi-piece projectile for a small arms cartridge includes a metal cup that has a bore, a plastic sheath having a through hole and a high-density core. The cup is a cylindrical metal structure having a bore. The sheath is a cylindrical end and a conical end and a through hole. The core is a cylindrical structure having conical end and a blunt end. The projectile is assembled by placing the core in the through hole of the sheath and then pressing the sheath into the bore of the cup. The assembled projectile is attached to the cartridge by crimping the cup to the orifice in the end of the cartridge casing after it is filled with the propellant. When the projectile is fired all of the components remain coupled together but break apart upon impact with a target. Because the core has a higher mass than the other components the components separate very easily, the majority of the kinetic energy remains in the core. Once separated from the other components, the core is able to penetrate through various protective materials.

18 Claims, 7 Drawing Sheets

SPECIAL PURPOSE SMALL ARMS AMMUNITION

CROSS REFERENCE TO RELATED APPLICATIONS

This patent application is a continuation in part of U.S. patent application Ser. No. 12/246,010 filed Oct. 6, 2008, entitled "SPECIAL PURPOSE SMALL ARMS AMMUNITION" which is a continuation of U.S. patent application Ser. No. 11/584,736 filed on Oct. 19, 2006, entitled "SPECIAL PURPOSE SMALL ARMS AMMUNITION" which is now U.S. Pat. No. 7,455,015.

BACKGROUND

Hand held portable firearms including pistols, revolvers, rifles, light machine guns and ammunition used with these small arms have existed for many years. Ballistics is the science that deals with projectiles in motion, including their terminal performance upon target strike. Ballistics can be divided into four main categories: interior, intermediate, exterior and terminal ballistics. Interior ballistics covers all processes from the point of primer strike to that instant at which the projectile just clears the muzzle. Intermediate ballistics examines all near muzzle blast field effects and interactions with the projectile, whilst exterior ballistics is concerned solely with the projectile's region of free, uninterrupted flight. Terminal ballistics describes the projectile's interactions with the target. Targets are generally classified as being either "soft" or "hard". Soft targets include living creatures including animals and people and hard targets are typically man made objects such as buildings, vehicles and general defense material. In many situations, hard targets can protect soft targets, for example, a person within an armored vehicle or wearing protective body armor.

For optimal performance, different types of projectiles are used for hard and soft targets. Hard target projectiles are designed to penetrate through the hard protective materials in order to disrupt the critical internal components of the target. In contrast, soft target projectiles are designed to enter and deposit all of their energy within the body in order to maximize the terminal effect. A projectile that enters and exits a soft target may not cause substantial injury if critical organs and structures are not encountered along the projectile's trajectory through the body.

With reference to FIG. 1, the projectile 109 is coupled to other components to form a cartridge 101. The cartridge 101 components include: the head 111, cartridge casing 103, primer 105, propellant 107, and projectile 109. The cup 102 is a circular metal structure attached to the base of the cartridge casing 103 that is a thin metal cylindrical structure. The primer 105 is a highly sensitive pyrotechnic composition that is stored in the cup 102. The propellant 107 is a combustible energetic material that is stable in storage and transportation, but burns rapidly into gaseous combustion products when ignited. The propellant 107 is contained in the cartridge casing 103. The front of the cartridge casing 103 forms a circular mouth having an inner diameter. The projectile 109 or bullet is a solid, hollow or composite metal structure that typically has a cylindrical body with a pointed nose. The projectile 109 is an interference fit into the inner diameter of the mouth of the cartridge casing 103. The projectile may also be crimped into the mouth of the cartridge casing. The coupling of the projectile 109 to the casing 103 holds the cartridge 101 components together.

To launch the projectile, the cartridge 101 is placed in the chamber of the small arm. The interior ballistics begin when the user activates the trigger, thereby, enabling the firing pin to strike the primer 103 causing it to ignite. The burning primer 103 emits a stream of hot gases and incandescent particles that contact and initiate the burning of the propellant 107. As the propellant 107 granules burn they are converted into expanded gaseous products. The pressure from the expanding gas exerts a force across the base area of the projectile 109, causing it to separate from the mouth of the casing and travel through the bore of the firearm. The instant the projectile first begins to move is known as the "shot start" time. The outer diameter of the projectile 109 has a bearing surface that contacts the rifling form within the bore. The contact with the rifling engraves the projectile 109 causing it to rotate axially within the bore. The in-bore frictional forces associated with engraving have a significant bearing on backpressure, propellant 107 burning rate profile and peak chamber pressure within the firearm.

The "all burnt" point occurs when all propellant granules are said to have been consumed and may occur when the projectile has traveled about one half to two thirds of the length of the barrel. An early all-burnt point may result in a greater thermal efficiency with more of the available chemical energy converted into projectile kinetic energy and less energy appearing as light, heat and blast. Increased thermal efficiency may cause higher muzzle velocities, higher peak chamber pressures and mechanical loads on the firearm.

Intermediate ballistics examines all near muzzle blast field effects and interactions with the projectile. As the projectile 109 exits the barrel, the near muzzle blast overpressure may typically be about 15% of the peak chamber pressure. The flow of high pressure gaseous products out of the muzzle continues to act on the base of the projectile 109 for a short time, such that the projectile's 109 maximum velocity occurs at a short distance after it has left the barrel. The projectile 109 then enters a region of free flight known as exterior ballistics, on its way to target strike. The time interval between shot start and target strike is the time of flight.

With reference to FIG. 2, a projectile 109 is shown separated from the cartridge. Small arms projectiles usually consist of a nose section or forebody 113, a cylindrical bearing section or midbody 115 which is engraved into the bore and if it has one, a tapered rear section known as the afterbody 117. The projectile's forebody 113 curvature may be described in terms of either a conical, tangent, secant or complex olive.

The midsection 115 may feature some form of circumferential groove or cannelure 119 that improve the crimped connection with the mouth of the cartridge casing. While the crimped coupling is a desirable precaution for overcoming de-bulleting in auto and semi-automatic weapons, it also ensures good, consistent backpressure for efficient propellant burning. Small arms projectiles can include a core comprised of lead doped with antimony, all of which is encased in a gilding metal jacket typically comprising 5-10% zinc with the balance as copper. Alternatively, the small arms projectiles might be comprised of unjacketed lead, doped with antimony to improve "stiffness".

The projectile may have design features that improve the exterior ballistic aerodynamic efficiency. For example, the projectile 109 may have a tapered or boat tailed afterbody 117 that is smaller in diameter than the diameter of its midbody 115. The tapered afterbody causes air flowing over the projectile 109 to converge rapidly into the low pressure drag region behind the afterbody 117. By decreasing the projectile's 109 base drag, the projectile's total drag is reduced and the aerodynamic efficiency is improved in all regions of flight: supersonic, transonic and subsonic. Efficient boat tails may typically have a taper angle of approximately 7 degrees.

The terminal ballistics begin when the projectile strikes the target. At contact, the projectile may completely perforate and pass through the target, penetrate and remain within the target, or strike the target surface without breaching the surface structure. The terminal ballistics will depend upon the design of the projectile and the nature of the target. There are different types of projectiles that are used for different applications including homogeneous projectiles and jacketed projectiles. Homogeneous projectiles are constructed from a single piece of material such as annealed solid copper projectiles and yellow brass projectiles. The main advantage of homogeneous projectiles is that they have virtually no asymmetry in their radial mass distribution, that is, all else being equal, they are effectively perfectly balanced projectiles that can withstand extremely high angular velocities if required. This axial rotation is typically quantified in units of revolutions per minute.

Another type of projectile is the jacketed projectile which uses high hardness steel cores or tungsten/alloy cores that are placed within a gilding metal jacket for greater penetration of hard targets. These "full metal" jacketed projectiles are typically used by the military. As an alternative to alloy cores, the jacketed projectiles may also have composite cores having a plurality of core components. An example of a jacketed projectile having a composite core is Fabrique Nationale's 5.56 mm×45 SS109, otherwise known as NATO's second small arms standard as defined by STANAG 4172. The SS109 projectile has three core components: an air-space behind the nose cone, a high hardness truncated conical steel penetrator in the forebody and a lead/antimony base core. The core components are housed within a gilding metal jacket.

SUMMARY OF THE INVENTION

The present invention is a multiple component small arms projectile. The inventive projectile assembly includes a cup, a sheath and a core. The cup is a cylindrical member that has a first inner diameter towards a front edge of the cup and a smaller second inner diameter. In an embodiment, the inner diameter and the edge of the cup may form a chamfer that has an angle that is about 75°. The core is a solid cylindrical structure that has a pointed tip that has a blunt angle of about 60° to 110°. In contrast, most prior art projectiles have a much sharper projectile tip angle. The core of the inventive projectile is made of a high-density material that includes metal and has very high impact strength. A suitable core material is sintered tungsten carbide. The sheath is a cylindrical structure that has a through hole and an annulus formed on the through hole. The diameter of the annulus is smaller than the diameter of the through hole.

The assembled projectile has the core placed in the through hole of the sheath. An edge of the core formed by the junction of the cone and the outer diameter butt up against the annulus to hold the core in place. The sheath is then placed into the cup. This may be an interference fit with the outer diameter of the sheath slightly larger than the inner diameter of the cup. The sheath and core may then be pressed into the cup. Once the projectile is assembled, the cylindrical cup portion of the projectile may be crimped into the mouth of the cartridge case.

When the inventive projectile is fired, the rifling form in the barrel engages the outer diameter of the cup and causes the projectile to rotate about its axis. The outer diameter of the cup engages the rifling in the barrel of the firearm that induces rotation of the sheath and core when the projectile is fired. The projectile components remain together until they contact the target.

The stability of the projectile will depend upon the locations of the center of gravity and the center of pressure. Because the core is made of a high-density material it represents the single largest mass component of the projectile and the center of gravity is fixed and located towards the front of the projectile. The center of pressure is typically located in the projectile 109 forebody and is based upon the aerodynamic properties of the projectile at any given mach number where mach number is the ratio of the projectile's velocity over the local speed of sound in the media through which it is traveling. The projectile is also gyroscopically stabilized by the axial rotation of the projectile. Faster rotation results in increased stability. The projectile is more stable when the separation between the center of gravity and center of pressure is minimized. The configuration of the inventive projectile causes the center of gravity to be farther forward than traditional projectiles which results in improved flight stability.

When the cup, sheath and core make contact with a hard target, the impact causes the projectile components to become separated. The cup shears the sheath away, separates from the sheath and the core. The cup may also transfer its momentum to the base of core. Since the sheath is a softer, lighter material, the separation of the core from the sheath and cup consumes very little energy. The projectile reaction with the target will depend upon the type of target encountered. For a hard target, the majority of the kinetic energy is transferred to the core that has a very high mass and a small frontal area. The core is also very strong and its tip can remain intact as it penetrates the hard target.

If a soft target exists behind the hard target, the projectile may not cause maximum incapacity if it travels completely through the target. The core of the inventive projectile may become unstable as it enters the soft target and may rotate in a tumbling motion known as yaw. This rotation will cause the side profile of the projectile to become perpendicular to the core path and slow the core within the soft target body. If the soft target is unprotected, the core, cup and sheath components may all enter the soft target. The cup is unstable as it travels through the soft target and it may also yaw and stop very quickly. This yaw motion can cause more internal injury than a projectile that travels straight through a soft target.

DETAILED DESCRIPTION

The present invention is an armor piercing projectile used with small arms cartridges. The inventive projectiles are suitable for both hard and soft targets. The inventive projectile is intended to be used by homeland security or military personnel rather than civilians. Various design considerations were evaluated in the development of the inventive projectile and cartridge.

For both hard and soft target ammunition, the projectiles are designed to deposit the limited available energy within the target in order to achieve the desired terminal effect. In the case of effective soft target terminal effects, it is best to deposit all available energy into the soft target. In some applications, the projectile may be designed for a combination of both soft and hard targets. For example, if a particular soft target has the benefit of some form of intervening hard protection, then the projectile must be able to pierce the protective armor and deposit all of the remaining energy into the soft target.

There are other ammunition applications in which special projectile characteristics are required. For example, if firearms are being used to defend a ship or an aircraft, the projectiles must be able to injure a soft target, but not penetrate or damage the structural components of the vessel. Other specific ballistic performance requirements include a minimal shot line deflection projectile that would be used to accurately strike a target that is seen behind glass. Various other special use projectiles are contemplated.

The inventive cartridge is designed to function reliably and safely in the weapon. When filling the cartridge, the peak chamber pressures comply with the CIP and SAAMI specifications. The cup material properties, propellant burning rate and loading density also produce the required muzzle velocity without excessive pressure, blast, flash, flame or barrel fouling. The inventive projectile seats cleanly into the case mouth. This seating does not include any shaving, binding or buckling of the cartridge case. The inventive projectile is also able to withstand the high loads caused by feed-ramp impact and the sudden stop during auto and semiautomatic chambering. The inventive cartridge is able to maintain its structural integrity under extremes of temperature and humidity.

Figure 1:
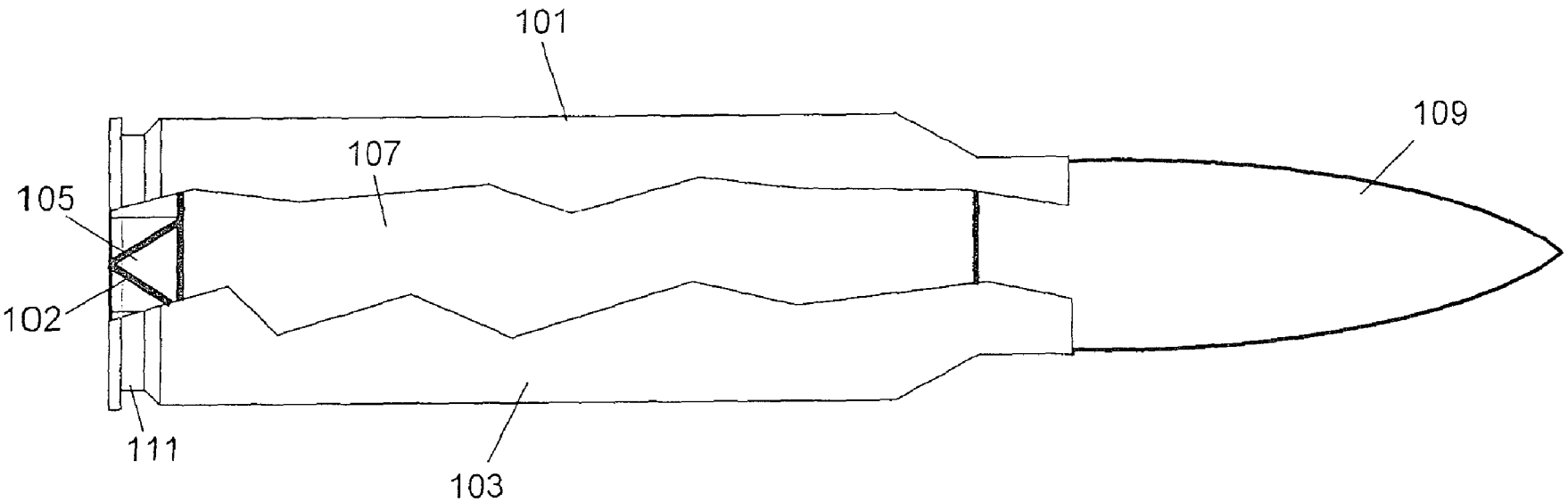
FIG. 1 (Prior Art)
FIG. 1 is a cross section of a cartridge.
Figure 2:
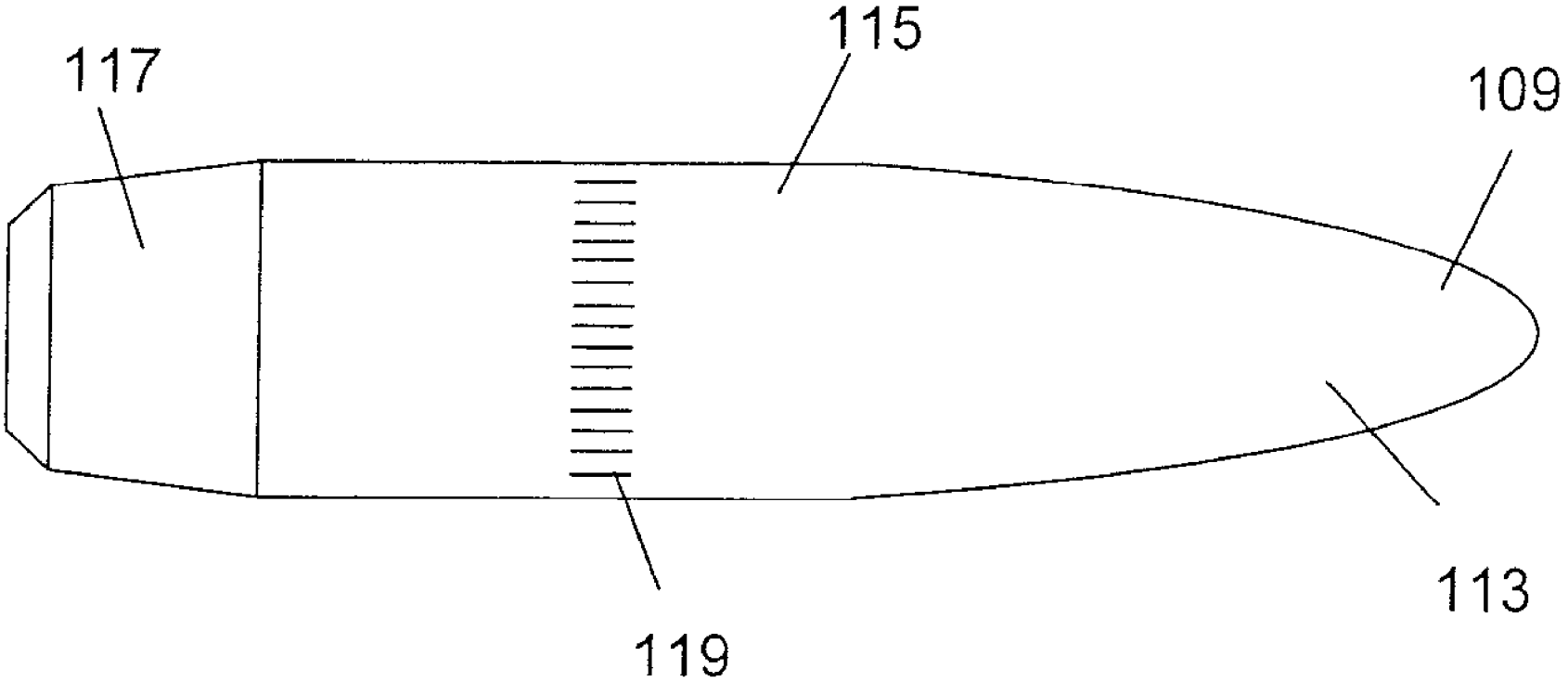
FIG. 2 (Prior Art)
FIG. 2 is a side view of a projectile.
Figure 3:
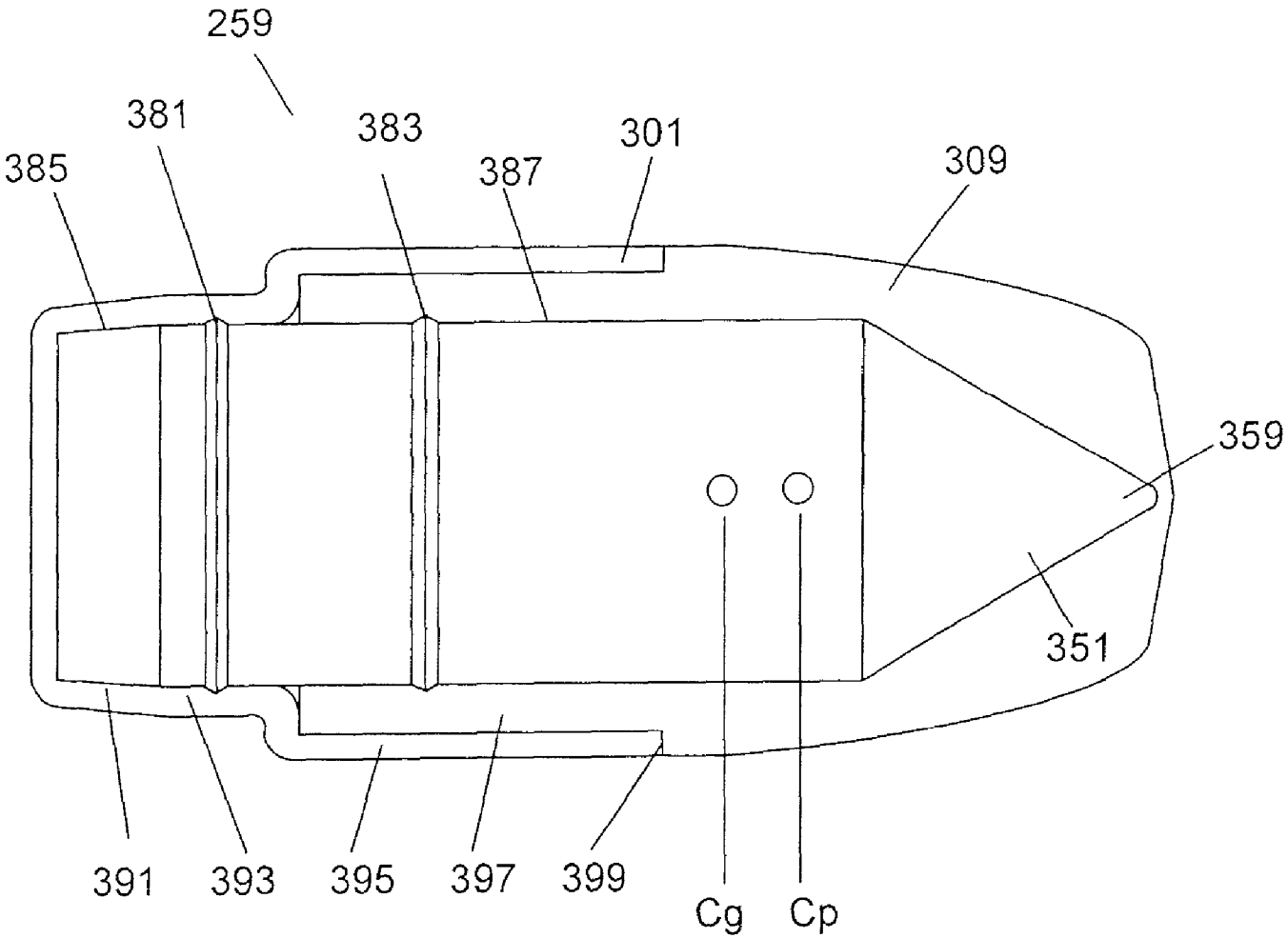
FIG. 3 is a cross section of an embodiment of the inventive projectile.

This inventive projectile 259 is illustrated in more detail in FIG. 3. The inventive projectile 259 has a composite construction that transmits a very high level of kinetic energy to the projectile core 351. In an embodiment, the projectile 259 has three main components: 1) a cylindrical cup 301, 2) a sheath 309, and 3) a core 351. The core 351 is placed in the sheath 309 and the core 351 and sheath 309 are placed in the cup 301.

In an embodiment, the inventive projectile 259 is assembled by placing the core 351 into the borehole 321 of the sheath 309. The inner recessed volume of the sheath 309 can have an inner surface that corresponds to the outer surface of the core 351. The core 351 can include a raised circular ridge 383 that surrounds a cylindrical portion 387 of the core 351. The outer diameter of raised circular ridge 383 may be larger than the inner diameter of the recessed volume of the sheath 309. The core 351 may have an interference fit with the sheath 309 that causes the core 351 to remain in the sheath 309 after the projectile is fired.

The bottom of the sheath 309 and the core 351 are then pressed into the cup 301. In an embodiment, the core has a raised circular ridge 381 that has an outer diameter that is larger than the inner diameter of the cup 301 and there may be an interference fit with the inner diameter of the cup 301 and the core 351. Because the core 351 may be compressed to fit into the cup 301, a press may be used to assembly the projectile 259 components. The cup 301 can include a second cylindrical section that has a wider inner diameter that surrounds a back portion of the sheath 309. A front edge of the cup may be adjacent to an annular portion of the sheath 399.

The components of the projectile 259 should be coaxial. The components must be tightly coupled so that as the projectile travels through the barrel of the firearm and begins its axial rotational acceleration, the multiple sub-components spin up at the same rate and are held tightly together when launched from the firearm. Details of each projectile 259 component are illustrated in other figures.

Figure 6:
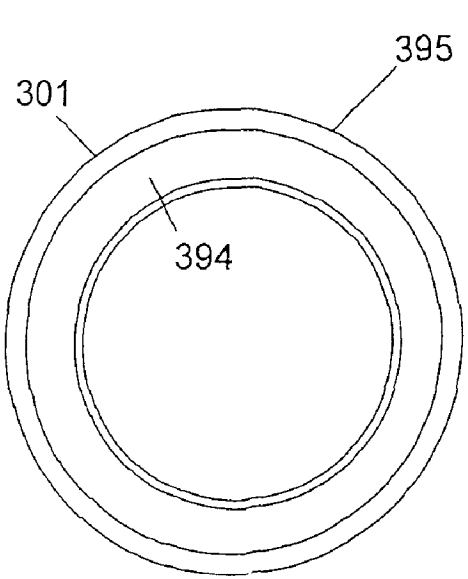
FIG. 6 is a front view of the cup of the inventive projectile.
Figure 5:
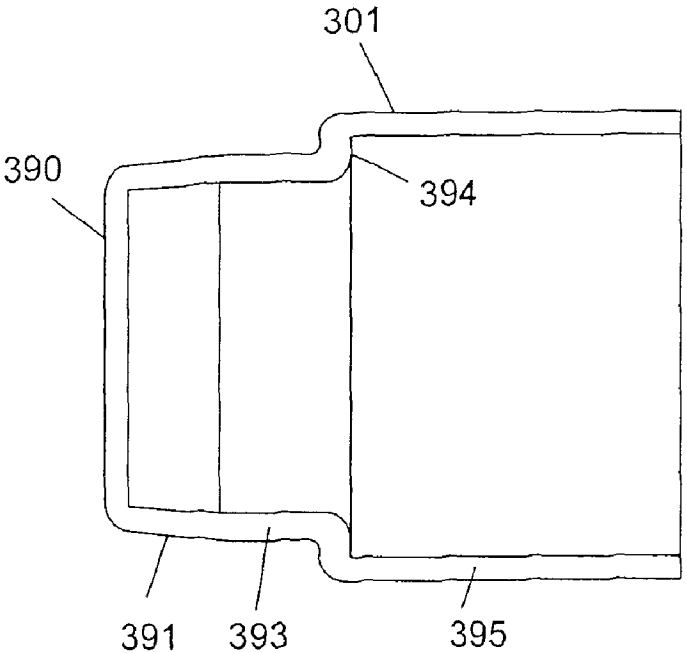
FIG. 5 is a side view of the cup of the inventive projectile.
Figure 4:
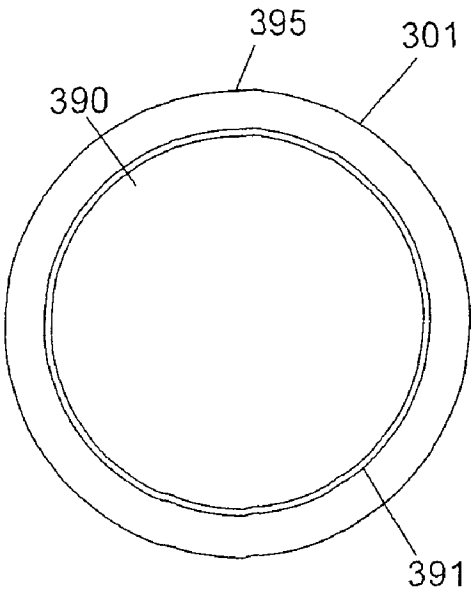
FIG. 4 is a rear view of the cup of the inventive projectile.

An embodiment of the cup is illustrated in FIGS. 4-6. The cup 301 is a compliant, low fouling, cylindrical structure that is preferably made of or plated with a gilding metal such as copper, brass or steel. In an embodiment, the cup 301 has a base 390, a tapered section 393, a first cylindrical portion 393, a second cylindrical portion 395 and an annular portion 394 between the first cylindrical portion 393 and the second cylindrical portion 395. In the assembled projectile, the base 390, tapered section 393 and first cylindrical portion 393 are adjacent to the core and the second cylindrical portion 395 is adjacent to the back portion of the sheath.

Figure 9:
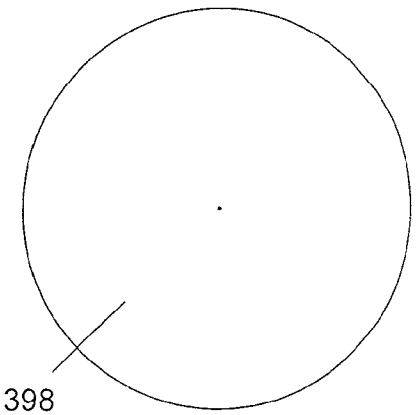
FIG. 9 is a front view of the sheath of the inventive projectile.
Figure 8:
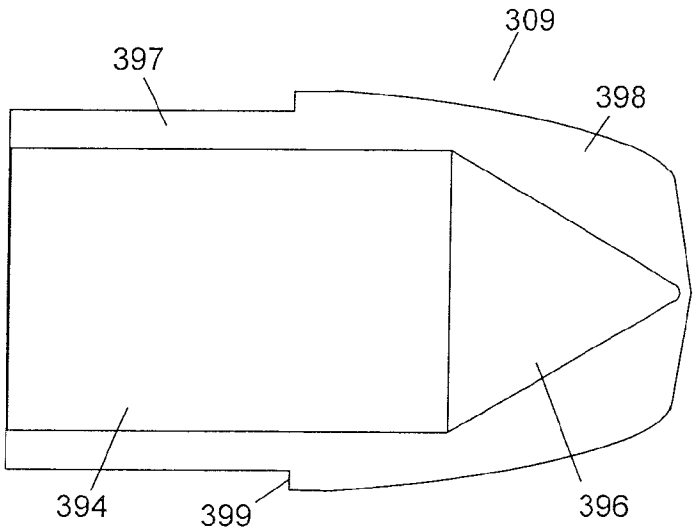
FIG. 8 is a side view of the sheath of the inventive projectile.
Figure 7:
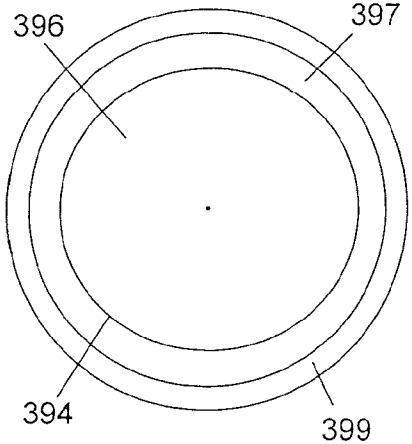
FIG. 7 is a rear view of the sheath of the inventive projectile.

With reference to FIGS. 7-9, an embodiment of the sheath 309 is illustrated. The sheath 309 has a recessed cylindrical volume 394 and a recessed conical volume 396 that runs through the center axis of the sheath 309 but may not extend through the sheath 309. The outer surfaces of the sheath 309 include a rear cylindrical portion 397 that may have a cylindrical outer diameter 397 and a tapered section 398 towards the front of the sheath 309. The sheath 309 can also have an annular area 399 between the cylindrical outer diameter 397 and a tapered section 398.

Figure 10:
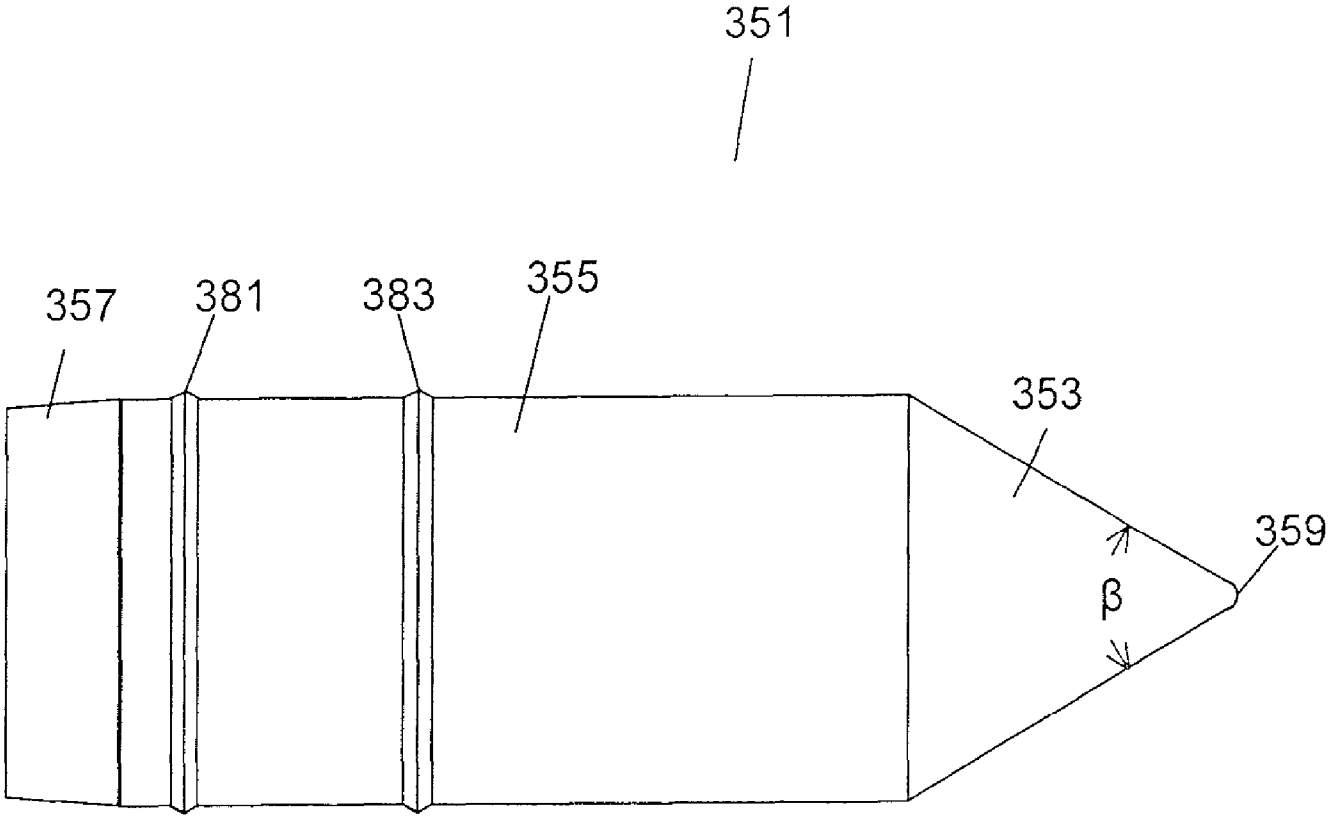
FIG. 10 is a side view of the core.

With reference to FIG. 10, an embodiment of the core 351 is illustrated. The core 351 can be made of a high-density material that is very strong and shatter resistant, such as pure tungsten, tungsten carbide or high hardness steel. In order to provide the most kinetic energy to the target, most of the mass of the projectile can be in the core 351. The core 351 can include a conical section 353, a cylindrical section 355 and a tapered end 357. The cylindrical portion 355 can include two raised circular ridges 381, 383 around the outer diameter of the cylindrical portion 355. The first circular ridge 381 can have an outer diameter than is larger than the inner diameter of the cup. The second raised circular ridge 383 can have an outer diameter that is larger than the inner diameter of the sheath. The two raised circular ridges 381, 383 create an interference fit with the cup and the sheath when the ammunition is assembled which holds the components together when the ammunition is filed. The components may only separate after the ammunition has struck an object such as the intended target.

The conical section 353 of the inventive core 351 has a fairly blunt tip. The angle β of the conical section 355 may be between about 45° to 160°. The tip of the conical section 353 has a radius 359 that is designed to minimize the possibility of a brittle fracture of the core 351. In contrast, many prior art projectiles have very sharp pointed tips, which are prone to asymmetric fracture patterns and reduced hard target penetration. An asymmetric fracture failure of a core will result in reduced penetration of a hard target.

In addition to enhancing impact performance, a blunter tip allows more material and mass to be placed at the front of the core 351. In an embodiment, the core 351 is fabricated through a sintering process in which powdered tungsten and carbide particles are placed in a die. The powder is pressed into the final core shape and heated until the tungsten and carbide particles are partially melted and fused together. The resulting projectile has a density that is nearly equal to a solid core 351. Tungsten carbide has very high strength, hardness, rigidity and impact resistance. The compressive strength of the sintered tungsten carbide is also higher than melted and cast or forged metals and alloys. Tungsten carbide compositions range from two to three times as rigid as steel and four to six times as rigid as cast iron and brass.

Figure 11:
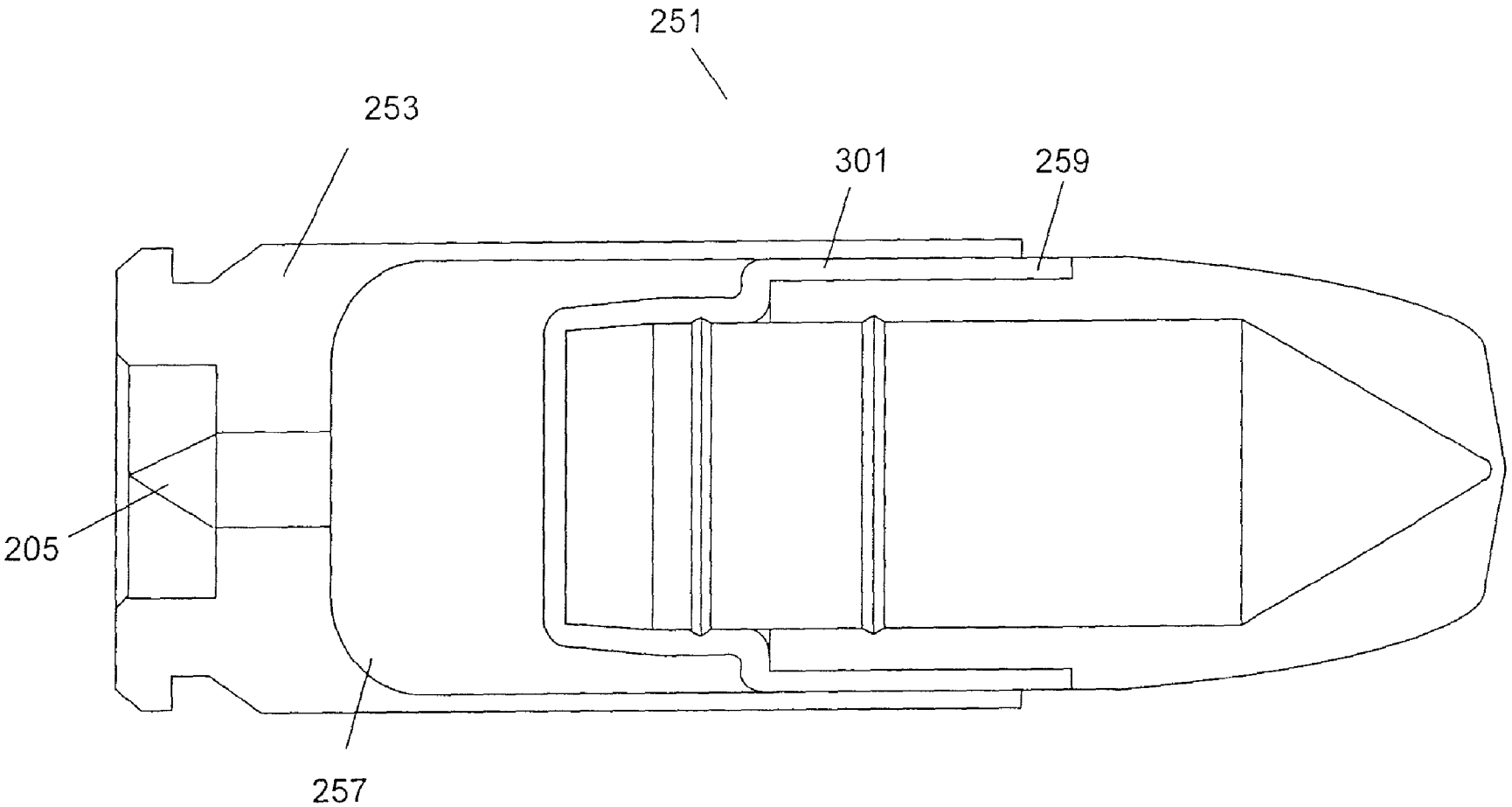
FIG. 11 is a cross section of a cartridge that includes the inventive projectile.

With reference to FIG. 11, an embodiment of a cartridge 251 that includes the inventive projectile 259 is illustrated. The cartridge 251 includes a casing 253, a primer 205 in the head 211, propellant 257 and the inventive projectile 259. In an embodiment, the outer diameter of the second cylindrical portion of the cup 301 fits within the inner diameter of the casing 253 and the casing 253 is crimped to the projectile 259. The cup 301 may have some form of circumferential groove or cannelure that improves the crimped connection with the mouth of the cartridge casing 253.

The cartridge with the inventive projectile is shot like a prior art cartridge. When the trigger is actuated, the firing pin ignites the primer 205 that causes the propellant 257 to rapidly burn. The expanding gaseous combustion products 257 cause the projectile 259 to separate from the casing 253 and travel through the bore of the firearm. The outer diameter of the cup 301 engages the rifling form in the barrel of the firearm causing the projectile 259 to rotate about its center axis. The inventive projectile 259 is uniformly engraved by the rifling form causing the projectile 259 to rotate without any gas blow by, base deformation or excessive barrel fouling. The rotation stabilizes the projectiles 259 as they move through the air minimizing their dispersion. The rotational forces are transmitted from the sheath to the cup 301 and the core and the tight fit of the projectile 259 components causes all of the components to rotate together in a unitary manner improving the projectile stability.

With reference to FIG. 3, after the projectile is launched from the firearm, its free-flight stability is influenced by the positions of the center of gravity $C_g$ and the center of pressure $C_p$. The center of gravity $C_g$ is the weight balance point of the projectile and the center of pressure $C_p$ is the point in the projectile at which all of the free-flight aerodynamic drag forces can be said to be acting. For subsonic projectiles such as arrows that have feathering and airplanes that have wings, elevator and a rudder, the $C_g$ is typically forward of the $C_p$. In the case of a ball bearing, the $C_g$ and the $C_p$ are collocated. All projectiles prefer to fly with their $C_g$ forward of the $C_p$ and it is only due to gyroscopic spin stabilization afforded by rifling that typical small arms projectiles will fly with their $C_g$ behind their $C_p$.

For the inventive projectile 259, the position of the $C_g$ remains constant but the position of the $C_p$ can vary dynamically with projectile velocity. The $C_p$ is generally forward of $C_g$ and the separation between $C_g$ and $C_p$ is known as the "static margin." Projectiles with a smaller static margin generally have greater inherent dynamic stability. A high stability projectile has less drag than a low stability projectile and will better retain its velocity and kinetic energy further down range.

The rotation of the projectile influences the stability of the projectile. In general, the projectile's rate of rotation is proportional to the stability of the projectile. The rotation causes gyroscopic inertia that stabilizes the projectile and causes it to resist change in its orientation. If the projectile spins too fast it may be "over stabilized" and may remain in the orientation that it was fired. Over stabilization may be problematic if the projectile's nose does not follow the arcuate curvature of the projectile trajectory due to gravitational forces. This is not normally a problem for small arms fired over extremely short, close quarter battle ranges because the projectile trajectory will typically be very flat. Conversely, if the projectile does not have enough spin the projectile may be unstable and the aerodynamic drag forces will cause the projectile to rotate and eventually tumble through the air.

As discussed above, the position of the $C_p$ is variable and changes based upon the velocity of the projectile. At supersonic velocities, the $C_p$ is located farther back on the projectile than at subsonic velocities. The projectile may be more stable when the $C_p$ is behind the $C_g$ and less stable when the $C_p$ is farther in front of the $C_g$. The $C_p$ can be located at substantially the same point as the $C_g$, behind the $C_g$ or in front of the $C_g$. In order to improve the stability of the projectile, the inventive projectile is designed to have as much of its mass in the core at the front of the projectile as possible.

The $C_g$ of the inventive projectile is fixed but designed to be towards the front of the projectile. The core 351 is made of high-density material and the cup 301 and sheath 309 are made of much lower density materials. Because the sheath 309 and cup 301 are made of lighter materials, the core 351 primarily controls the location of the center of gravity. The tip 359 of the core 251 has a broad angle that is substantially different than the more traditional long tapered and pointed tip. This blunter tip 359 provides more volume so that the tip 359 has more material and more mass. Since the core 251 is towards the front of the projectile 259 most of the mass is also towards the front of the projectile. With the $C_g$ farther forward the inventive projectile 259 has a shorter static margin and has more stable external ballistics.

The terminal ballistics of the inventive projectile is also very different than the prior art projectiles. The components of the inventive projectile remain together until the projectile strikes the target. At contact, the cup 301 breaks the sheath 309 and the components separate. The terminal ballistics reaction of the projectile components will depend upon the type of target.

For a hard target, the projectile 259 will disassemble upon contact and only the core 351 may penetrate the target. The core 351 and the sheath 309 are the first to contact the target. The impact causes the chamfered edge of the cup 301 to cleanly shear the sheath 309 away from the high-density core 351. The sheath 309 may also break along the grooves 329 causing the conical section 323 to splinter into many smaller petals. The core 351 is then free to penetrate the hard target. Because the sheath 309 is sheared away very easily, the core 351 loses very little energy as it penetrates the target. The ability of the inventive projectile to penetrate hard targets is enhanced because only a minimal amount of energy is consumed as the high sectional density core frees itself from the sheath 309 and cup 301. The core 351 retains the remaining kinetic energy. Since nearly all of the kinetic energy remains with the core 351, the majority of the energy is directed towards the penetration of the hard target.

In many cases, the hard target is protecting a soft target. After the core 351 has completed its primary role of penetrating the hard or intervening target, the inventive core is designed to deposit all residual energy as quickly as possible into the underlying soft target. As the core 351 enters the soft target, it creates a cavity in the target media. The degree to which permanent and temporary cavitation occurs depends upon the size, shape, and velocity of the projectile core 351 as well as the nature of the soft target media. A wide core 351 that has a blunt shape, higher velocity, or any combination thereof will increase the width of the permanent cavity. Optimized temporary cavitation is best achieved by maximizing the projectile core's 351 frontal area through yaw, resulting in the greatest residual energy deposition rate.

A projectile having a long core and narrow body with a sharp pointed tip will crush only the tissue directly in front of a small portion of its diameter while tissue closer to the edge of the core will simply flow around it and be pushed outwards. A core having a blunter, flatter tip generates a much larger "bow wave" as it uses more of its face to crush the target tissue, but loses velocity more quickly in the process and is more likely to remain within the target.

Rather than traveling straight through the soft target, the inventive core 351 is wide with a blunt tip. The core 351 is designed to lose stability causing it to tumble and rotate in yaw in the soft target. Ideally, the core 351 will rotate so that it travels sideways with the long axis perpendicular to the direction of travel. This rotation causes the core 351 to present its largest possible frontal area and cause the largest drag force on the projectile core 351 within the soft target. In addition to a single 90° rotation, the core 351 may continue to tumble and rotate within the soft target that also slows the core 351 and may prevent its exit from the target. This tumbling and yaw motion increases the frontal area of the inventive projectile core 351 causing it to decelerate rapidly. The tumbling action also causes explosive temporary cavitation and a permanent narrow channel cavity.

If a soft target is not protected by a protective layer or there is only a minimal intervening material over the soft tissue target, the core 351 and other projectile components can penetrate the target. As discussed above, the core 351 is designed to penetrate and then tumble within the target rather than passing through the soft target. The core 351 will rotate with a significant degree of yaw to present the increased frontal area greater drag so that the core deposits the bulk of its residual kinetic energy within the target. The instability of the core 351 within the soft target is achieved through various core 351 properties at the time of impact including: angular velocity (spin rate), length to diameter ratio, static margin and yaw angle at impact.

In addition to the core 351, the cup 301 and sheath 309 components of the projectile can also penetrate the soft target. Upon encountering an unprotected soft target, the inventive projectile exhibits a fundamentally different behavior to that observed when striking a hard target in that the core 351 remains integral with the cup 301. The cup 301 is a hard minimally deforming structure that is a full caliber diameter. When the projectile 359 first enters the soft target, for example, FBI ballistic gelatin (10% w/w at 4° C.), conical section 323 of sheath 309 immediately breaks free at the chamfer 307 of cup 301 as smaller fragments along the groove 329 form in sheath 309. The lightweight sheath's 309 petals decelerate rapidly in the soft target and as they have very little mass or kinetic energy, are less likely to produce internal injuries of any significance. These petals are usually contained within about the first 50 mm of travel into the FBI gelatin block. The core 351 is held firmly in the cup 301 by the remaining lower cylindrical section of sheath 309. The structural integrity of these remaining projectile components allows them to remain intact and move through the soft target as one piece. The "thumb tack" like appearance of the remaining projectile components causes them to tumble as one, through the soft target.

While the basic design of the projectile has been described, the kinetic energy package that is delivered to a target is governed by various physical factors including: the propellant mass, loading density and relative quickness (burning rate), the primer, the projectile mass, the range to the target and the maximum permissible chamber pressure. For hard target applications having a cartridge with a fixed energy package, the inventive projectile should generate the highest possible pressure at the projectile strike point in order to penetrate the armor. The sectional density (SD) of the core is defined as the ratio of a projectile's mass (m) to the square of its diameter (d) in accordance with the relationship $SD=m/d^2$. A high SD is achieved by using a small frontal projectile area, with a high projectile mass. A long cylindrical core provides the highest mass to density ratio, but a conical forebody is needed to improve the hard target surface penetration. By making the point blunt, more mass is maintained in a minimal core diameter. Also, the core should have a length and diameter that provides a strong structure. A thin core will tend to break, thus reducing the penetration capabilities.

Kinetic energy is defined by the formula $E_{kinetic}=\frac{1}{2}mv^2$, where m is the core mass and v is the core velocity. Thus, a projectile having a high core mass, high sectional density, high velocity and, therefore, high kinetic energy at impact, is able to exert a high force per unit area (pressure) at the target surface and have the greatest possible chance of hard target penetration.

The velocity is improved by using the fastest burning propellant with the highest loading density without exceeding the maximum permissible peak chamber pressure. The core mass is increased by using tougher, higher density core materials and lower density sheath and cup materials. As discussed, the core must also be very strong to avoid brittle fracture at impact. Sintered tungsten carbide is one of several suitable core materials as its high density and strength combine to resist brittle failure at impact. Because the core contains the majority of the mass, the majority of the kinetic energy is in the core rather than the cup or sheath. The sectional density and kinetic energy are primary factors in penetration mechanics.

The internationally accepted standard medium for testing bullets for performance on soft tissue is ballistic gelatine. Tests have shown that properly prepared and calibrated 10% (by mass) aqueous gelatine at 4° Celsius (FBI ballistic gelatine) correlates very closely to observed performance in soft target muscle tissue. Injury severity is generally characterized by the dimensions of the temporary cavity, the maximum depth of penetration and the dimensions of the permanent cavity formed in the gelatine by the passage of a projectile. The size of the temporary cavity represents the maximum radial displacement that tissue experiences as it is violently displaced by the passage of a projectile. In an elastic medium such as muscle tissue, the temporary cavity undergoes a series of decaying pulsations until the tissue establishes a new equilibrium rest position that defines the permanent cavity. By definition, all tissue within the volume of the permanent cavity will have been crushed and destroyed and will need to be debrided. The length of the wound tract is simply how far through the tissue the projectile has penetrated.

Another characteristic of the inventive projectile is that the finely dispersed, toxic lead cloud typically seen in x-radiographs of soft tissue impacted by lead based projectiles is completely absent in gelatine struck by the inventive ammunition projectile.

While the inventive projectile can be made in any number of calibers that correspond to the diameter of the projectile, testing was performed on a 9 mm version of the inventive projectile. In this example, the midbody was made of yellow brass, the sheath was made of Delrin and the core was made of sintered tungsten carbide at nearly full density and minimal porosity. The chamfer formed in the rim of the cup was 15°. Bulletproof clothing such as vests are made of many energy absorbent, high strength layers of high strength fabric. Each layer of fabric is compression molded with a binder resin to form the composite of Spectra 900. Examples of suitable fabric include a polyethylene fabric such as Spectra 900 and Spectra 1000, available commercially from Allied Signal Corporation of Petersburg, Va. and Morristown, N.J. Also suitable is an aramid fabric such as Kevlar 29 and Kevlar 49 manufactured by Dupont. The resin binder can be liquid binder such as Shell Krayton resin, laminates or other fiber bonding structures.

For testing purposes, 100 layers of hand gun bulletproof material were placed in front of a four inch thick phone book and a block of FBI ballistic gelatin. During testing the core of the projectile was able to penetrate completely through the 100 layers of bulletproof material and the phone book. At the point of impact, the sheath is broken by the chamfer in the cup and the core is separated from the sheath and cup. The cup was recovered from the bulletproof material whilst core perforated the ballistic gelatin placed behind the protective layers. The shape of the permanent cavity created by the impact of the core indicated that the core was spinning when it entered the gelatin.

In a further series of trials, individual 9 mm projectiles were easily able to perforate 12 mm thick aluminum plate, 7 mm thick mild steel plate, 12 mm thick laminated glass and the anti intrusion bar in a modern car door. When fired at a fully inflated modern steel belted radial tire, a 9 mm projectile also easily perforated the tread, steel plies, the bead and the folded J-J section of the steel rim upon exit.

When fired directly square on, 9 mm projectiles were easily able to pierce a modern car laminated windshield and hit the designated aim point located 50 cm behind the windshield. When fired at a 40 degree oblique angle of incidence, 9 mm projectiles were easily able to pierce a modern car laminated windshield and hit the designated aim point located 65 cm behind the windshield. The 9 mm projectiles were also easily able to penetrate a 35 mm solid wooden door backed by another 30 mm of particle board. All shots in these trials easily perforated the 1.3 mm thick aluminum witness sheets placed behind each target.

When fired from a P35 Browning 9 mm pistol in the free standing position, the 9 mm cartridges chambered flawlessly from the magazine, then fired, extracted and ejected perfectly, with all shots meeting the essential dispersion requirements. At the end of a 26 shot trial, the Browning pistol barrel showed no sign of fouling.

Although the same basic cup, sheath and core design is used for ammunition projectiles of various different sizes, some special design factors must be considered for different calibers of ammunition. For example, because the case volume of the 9 mm Parabellum, also known as the 9 mm Luger, 9 mm NATO and the 9 mm×19, is very small, careful consideration must be given to the primary role and desired terminal effects of the projectile. For example, if the primary role is penetration, the core may have a mass that is proportionally larger than the other components. In order to accommodate the mass without altering the caliber, the length of the projectile may have to be extended. This extended length may be more stable traveling through a soft target with less yaw motion. However, since the primary objective is to penetrate the hard target, the design compromise is acceptable. It is contemplated that various other design alternations can be made.

In other embodiments, the primary purposes may be to hinder a soft target but minimize damage to the target. In these embodiments, the core may include a marker, an irritant, visual impairment or any other type of hindering mechanism. In these embodiments, the chamfer of the cup may break the sheath and cause the separation of the projectile components. This separation of components may cause the release of the core hindering mechanism such as a dye marker ink or irritant.

In other embodiments, the projectile may be able to penetrate a hard target and deliver a hindering mechanism through a protective layer. In this embodiment, a hindering mechanism may be placed within the core or behind the core. The core may penetrate the protective layer as described above and the hindering mechanism contained within, or behind the core may be released after the core has passed through the protective layer. For example, a gas irritant may be released by the core.

In the foregoing, a special purpose small arms ammunition system has been described. Although the present invention has been described with reference to specific exemplary embodiments, it will be evident that various modifications and changes may be made to these embodiments without departing from the broader spirit and scope of the invention as set forth in the claims. Accordingly, the specification and drawings are to be regarded in an illustrative rather than a restrictive sense.

What is claimed is:

1. A projectile for a small arms cartridge comprising:

a cup having a base, a first cylindrical portion and a second cylindrical portion adjacent to the first cylindrical portion, the first cylindrical portion having a first inner diameter adjacent to the base and the second cylindrical portion having a second inner diameter that is larger than the first inner diameter;

a sheath having a cylindrical rear portion and a tapered front portion, the cylindrical rear portion placed within the second cylindrical portion of the cup and the tapered front portion extending forward from the cup; and a core having a rear portion, a cylindrical portion and a conical tip, the rear portion and the cylindrical portion placed against the base and the first cylindrical portion of the cup, the cylindrical portion and the conical tip placed within the tapered front portion of the sheath, the core having a first circular ridge having an interference fit with the first cylindrical portion of the cup for holding the core and the cup together until after the projectile has struck an intended target.

2. The projectile of claim 1 wherein the core includes a second circular ridge that is adjacent to the first cylindrical portion of the cup.

3. The projectile of claim 1 wherein the core has an interference fit with the sheath.

4. The projectile of claim 1 wherein the first cylindrical portion of the cup is shorter than the second cylindrical portion of the cup.

5. The projectile of claim 1 wherein the sheath does not include any slots or through holes.

6. The projectile of claim 1 wherein the cup includes an annular surface that is between the first inner diameter and the second inner diameter.

7. The projectile of claim 6 wherein the annular surface of the cup that is between the first inner diameter and the second inner diameter is adjacent to a rear edge of the sheath.

8. The projectile of claim 1 wherein the sheath includes an annular surface that is between the cylindrical rear portion and the tapered front portion.

9. The projectile of claim 8 wherein the annular surface that is between the cylindrical rear portion and the tapered front portion is adjacent to a front edge of the cup.

10. A projectile for a small arms cartridge comprising:

a cup having a base, a first cylindrical portion and a second cylindrical portion, the first cylindrical portion having a first inner diameter and the second cylindrical portion having a second inner diameter that is larger than the first inner diameter;

a sheath having a cylindrical rear portion, a tapered front portion and a recessed volume, the cylindrical rear portion placed within the second cylindrical portion of the cup; and a core having a cylindrical outer diameter, a first circular ridge having an interference fit with the first inner diameter of the cup for holding the core and the cup together until after the projectile has struck an intended target and a second circular ridge within the recessed volume of the sheath.

11. The projectile of claim 10 wherein the second circular ridge has an outer diameter that is larger than an inner diameter of the recessed volume of the sheath.

12. The projectile of claim 10 wherein the core has an interference fit with the sheath.

13. The projectile of claim 10 wherein the first cylindrical portion of the cup is shorter than the second cylindrical portion of the cup.

14. The projectile of claim 10 wherein the sheath does not include any slots or through holes.

15. The projectile of claim 10 wherein the cup includes an annular surface that is between the first inner diameter and the second inner diameter.

16. The projectile of claim 15 wherein the annular surface of the cup that is between the first inner diameter and the second inner diameter is adjacent to a rear edge of the sheath.

17. The projectile of claim 10 wherein the sheath includes an annular surface that is between the cylindrical rear portion and the tapered front portion.

18. The projectile of claim 17 wherein the annular surface of the sheath that is between the cylindrical rear portion and the tapered front portion is adjacent to a front edge of the cup.

* * * * *